US009656730B2

(12) United States Patent
Liberg

(10) Patent No.: US 9,656,730 B2
(45) Date of Patent: May 23, 2017

(54) CLOSED INCLINATION CHANGE SYSTEM

(71) Applicant: GVA CONSULTANTS AB, Göteborg (SE)

(72) Inventor: Lars-Olof Liberg, Strömstad (SE)

(73) Assignee: GVA Consultants AB, Göteborg (SE)

( * ) Notice: Subject to any disclaimer, the term of this patent is extended or adjusted under 35 U.S.C. 154(b) by 46 days.

(21) Appl. No.: 14/768,440

(22) PCT Filed: Feb. 13, 2014

(86) PCT No.: PCT/EP2014/052780
§ 371 (c)(1),
(2) Date: Aug. 17, 2015

(87) PCT Pub. No.: WO2014/125001
PCT Pub. Date: Aug. 21, 2014

(65) Prior Publication Data

US 2016/0001855 A1 Jan. 7, 2016

(30) Foreign Application Priority Data

Feb. 15, 2013 (NO) ..... 20130274

(51) Int. Cl.

| | |
|---|---|
| ***B63B 39/03*** | (2006.01) |
| ***B63B 43/06*** | (2006.01) |
| ***B63B 1/10*** | (2006.01) |
| ***B63B 1/12*** | (2006.01) |
| ***B63B 35/44*** | (2006.01) |

(52) U.S. Cl.
CPC ..... *B63B 39/03* (2013.01); *B63B 1/107* (2013.01); *B63B 1/125* (2013.01); *B63B 35/44* (2013.01); *B63B 43/06* (2013.01); *B63B 2001/128* (2013.01)

(58) Field of Classification Search
CPC ..... B63B 43/00; B63B 43/06; B63B 27/24; B63B 39/03
USPC ..... 114/74 R, 125
See application file for complete search history.

(56) References Cited

U.S. PATENT DOCUMENTS 3,209,715 A * 10/1965 Campbell ..... B63B 13/00 114/74 R
4,715,309 A * 12/1987 Liberg ..... B63B 43/06 114/125

FOREIGN PATENT DOCUMENTS

GB 2 163 115 7/1984

* cited by examiner

*Primary Examiner* — Lars A Olson
(74) *Attorney, Agent, or Firm* — Gary Machetta

(57) ABSTRACT

The present disclosure relates to a closed inclination change system (32) for a floating unit (10). The inclination change system comprises a plurality of inclination change assemblies (34, 36, 38, 40) and each one of the inclination change assemblies (34, 36, 38, 40) is adapted to be in fluid communication with each one of the other inclination change assemblies (34, 36, 38, 40).

Each one of the inclination change assemblies (34, 36, 38, 40) comprises a tank assembly (44) comprising a first tank (46), the tank assembly (44) comprising a tank assembly top portion (48).

Moreover, each one of the inclination change assemblies (34, 36, 38, 40) further comprises:

- a pump assembly (50) arranged to pump the fluid from the tank assembly (44), and
- an inlet conduit assembly (52) adapted to guide the fluid into the tank assembly (44) from another inclination change assembly (34, 36, 38, 40), the inlet conduit assembly (52) having a conduit top portion (54) that is located above the tank assembly top portion (48).

25 Claims, 7 Drawing Sheets

CLOSED INCLINATION CHANGE SYSTEM

TECHNICAL FIELD

The present disclosure relates to a closed inclination change system according to the preamble of claim 1. Moreover, the present disclosure relates to a method for imparting an inclination change to a floating unit.

BACKGROUND OF THE INVENTION

A floating unit is generally adapted to float in a floating condition within a predetermined draught range and a predetermined inclination range. As an example, a floating unit may be adapted to float in an operational floating condition with a predetermined operational draught and at even keel, i.e. with an inclination that is substantially zero.

The inclination of a floating unit may change for a plurality of reasons. For instance, if a load is placed on the floating unit, the unit may be imparted an inclining moment which in turn will change the inclination of the unit. As another example, when cranes of the unit are operated in order to lift and/or transfer a load, an inclination change is often obtained. Furthermore, a draught change of the floating unit may result in a change of the inclination of the floating unit.

In order to ensure that a floating unit assumes a floating condition with an inclination within a predetermined inclination range, it is common to engage a ballast system of the floating unit. To this end, ballast water may be transferred between ballast tanks of the floating unit in order to obtain a desired inclination of the floating unit. However, a ballast system is generally adapted to be in direct fluid communication with the water ambient of the floating unit. Moreover, the ballast system is generally designed to alter the draught of the floating unit. As such, if the ballast system is incorrectly operated during an inclination change operation, this may result in an undesired draught and/or an undesirably large inclination of the floating unit.

In order to reduce the risks that may possibly be associated with the above-discussed use of the ballast tanks, GB 2 163 115 proposes the use of an inclination change system with tanks that may be used for altering the inclination of a floating unit. To this end, the '115 system permits water to flow under gravity from one tank to another to influence the heel and/or trim of a floating unit.

Although the '115 system may be suitable for many types of floating units, it may nevertheless be desirable to obtain an inclination change system with a reduced risk of obtaining undesired inclinations in the event of a malfunctioning inclination change system.

SUMMARY OF THE INVENTION

One object of the present disclosure is to provide an inclination change system which may alter the inclination of a floating unit and which also has an appropriately low risk of imparting undesired inclinations to the floating unit.

This object is achieved by a closed inclination change system according to claim 1.

As such, the present disclosure relates to a closed inclination change system for a floating unit, the inclination change system comprising a plurality of inclination change assemblies. Each one of the inclination change assemblies is adapted to be in fluid communication with each one of the other inclination change assemblies. Moreover, each one of the inclination change assemblies comprises a tank assembly comprising a first tank. The tank assembly comprises a tank assembly top portion.

According to the present disclosure, each one of the inclination change assemblies further comprises:

- a pump assembly arranged to pump the fluid from the tank assembly, and
- an inlet conduit assembly adapted to guide the fluid into the tank assembly from another inclination change assembly, the inlet conduit assembly having a conduit top portion that is located above the tank assembly top portion.

The closed inclination change system presented hereinabove implies that that fluid may be transferred between the tank assemblies of the inclination change assemblies in order to impart an inclination change to a floating unit hosting the closed inclination change system. Moreover, by virtue of the facts that each one of the inclination change assemblies comprises a pump assembly and that an inlet conduit top portion is located above the tank assembly top portion, an appropriately low risk of imparting undesired inclinations, due to fluid flow by gravity, to the floating unit is obtained.

To this end, it should be noted that the position of the inlet conduit top portion above the tank assembly top portion implies that the risk of obtaining a flow by gravity of fluid from a tank assembly via the inlet conduit assembly associated with the tank assembly is appropriately low.

As used herein, the expression "inclination change system" relates to a system that is adapted to impart an inclination change to a floating unit, e.g. around the longitudinal and/or transversal axis of the unit. Preferably, the inclination change system is adapted to impart the inclination change without a substantial change of the draught of the floating unit. Moreover, the inclination change system is preferably adapted to impart an inclination change to a floating unit around any horizontal axis, i.e. around any azimuth.

Moreover, as used herein, the expression "closed inclination change system" relates to an inclination change system that is adapted to impart an inclination change to a floating unit without the need of adding fluid to, or removing fluid from, the inclination change system as such. In particular, as used herein, the expression "closed inclination change system" relates to a system that is adapted to impart an inclination change to a floating unit without the need of transferring fluid to and/or from the water ambient of the floating unit hosting the inclination change system.

By virtue of the fact that the inclination change system according to the present disclosure may impart inclination changes to a floating unit without the need for adding or removing fluid from the floating unit, the inclination change system according to the present disclosure may also be suitable to be used during an inclination test of the floating unit. During an inclination test, fluid may be transferred between the inclination change assemblies in order to obtain a plurality of floating conditions with different inclinations. Based on information as regards the actual inclinations and information concerning the amount of fluid in each inclination change assembly for each floating condition, it is possible to determine an estimate of the vertical centre of gravity of the floating unit.

Optionally, at least one of the inclination change assemblies comprises a first vent pipe assembly. The first vent pipe assembly comprises an air inlet located at the upper portion of the tank assembly. The first vent pipe assembly comprises an air outlet which is adapted to be in fluid communication with the environment ambient of the closed inclination change system. The air outlet is located at a position above the tank assembly top portion, preferably above the conduit top portion.

Optionally, at least one of the inclination change assemblies comprises a second vent pipe assembly. The second vent pipe assembly comprises a second air inlet located at the conduit top portion. Moreover, the second vent pipe assembly comprises a second air outlet which is adapted to be in fluid communication with the environment ambient of the closed inclination change system. The second air outlet is preferably located above the inlet conduit top portion. The provision of the second vent pipe may reduce the risk that a suction due to the siphon principle may occur in the inlet conduit assembly.

Optionally, at least one of the inclination change assemblies comprises an inlet cut-off valve located in the tank inlet conduit assembly, the inlet cut-off valve being located between the conduit top portion and the tank assembly.

Optionally, at least one of the inclination change assemblies comprises a pump assembly with a high side and a low side, the at least one inclination change assembly further comprising a check valve located downstream the low side.

By virtue of the fact that at least one of the inclination change assemblies comprises a check valve downstream the low side of its pump assembly, an appropriately low risk is obtained that the outlet of the tank assemblies of two inclination change assemblies will be open simultaneously to thereby allow a fluid communication between the outlets of the tank assemblies.

Optionally, at least one of the inclination change assemblies comprises a pump assembly cut-off valve located between the low side and the tank assembly.

Optionally, at least one of the inclination change assemblies comprises a control valve adapted to control a fluid flow to and from the inclination change assembly.

Optionally, the tank assembly of at least one of the inclination change assemblies comprises a second tank, the second tank being located at least partially above the first tank.

Optionally, the tank assembly of each one of the inclination change assemblies comprises a second tank. The second tank is located at least partially above the first tank.

Optionally, the inlet conduit assembly is also adapted to guide the fluid into the second tank from another inclination change assembly.

Optionally, the first tank assembly is adapted to provide a fluid communication between the second tank and the first tank.

Optionally, the first tank assembly is adapted to transfer fluid from the first tank to the second tank using the pump assembly.

Optionally, the closed inclination change system further comprises a feeding circuit adapted to be in fluid communication with each one of the inclination change assemblies.

Optionally, the pump assembly of at least one of the inclination change assemblies comprises a submersible pump.

A second aspect of the present disclosure relates to a floating unit comprising a closed inclination change system according to the first aspect of the present disclosure.

Optionally, the floating unit comprises a ballast system in addition to the closed inclination change system.

Optionally, the floating unit is a semi-submersible unit.

Optionally, the semi-submersible unit comprises four outermost supporting columns. The closed inclination change system comprises four inclination change assemblies. Each one of the four inclination change assemblies is associated with an individual one of the four outermost supporting columns such that the tank assembly of the inclination change assembly is located at least partially in and/or beneath the supporting column.

Optionally, the semi-submersible unit comprises a ring pontoon.

Optionally, the total volume of the tank assemblies of all the inclination change assemblies of the closed inclination change system may be less than 5%, preferably less than 2%, of the total volume displaced by the floating unit when the floating unit floats at an operational draught.

The fact that the total volume of all the tank assemblies closed inclination change system is below any one of the above limits implies that possible consequences of a malfunctioning closed inclination change system may be relatively moderate.

A third aspect of the present disclosure relates to a method for imparting an inclination change to a floating unit using a closed inclination change system. The inclination change system comprises a plurality of inclination change assemblies. Each one of the inclination change assemblies is adapted to be in fluid communication with each one of the other inclination change assemblies. Moreover, each one of the inclination change assemblies comprises: a tank assembly comprising a first tank, the tank assembly comprising a tank assembly top portion.

Each one of the inclination change assemblies further comprises: a pump assembly arranged to pump the fluid from the tank assembly, and an inlet conduit assembly adapted to guide the fluid into the tank assembly from another inclination change assembly, the inlet conduit assembly having a conduit top portion that is located above the tank assembly top portion.

Moreover, the method comprises:

providing a fluid communication from the pump assembly of a first of the inclination change assemblies to the tank assembly of a second of the inclination change assemblies, and operating the pump assembly such that fluid is pumped from the tank assembly of the first inclination change assembly to the tank assembly of the second inclination change assembly.

Optionally, the tank assembly of each one of the inclination change assemblies comprises a second tank, the second tank being located at least partially above the first tank. The method comprises:

determining if it is possible to obtain the inclination change by transferring fluid between the first tanks only;

if it is possible, providing a fluid communication from the pump assembly of a first of the inclination change assemblies to the first tank of the tank assembly of a second of the inclination change assemblies, and operating the pump assembly such that fluid is pumped from the first tank of the tank assembly of the first inclination change assembly to the first tank of the tank assembly of the second inclination change assembly.

Optionally, the method comprises transferring fluid that is not needed in order to obtain the inclination change to the second tanks prior to transferring fluid between the first tanks. The feature that not needed fluid is transferred to the second tanks implies that only the amount of fluid that is actually needed for achieving the desired inclination change is present in the first tanks. As such, if the closed inclination change system malfunctions during an inclination change procedure, e.g. due to an incorrect operation of the system and/or due to one or more impaired components of the system, the consequences of such malfunctioning may be relatively low.

Optionally, the method comprises:

determining if it is possible to obtain the inclination change by transferring fluid between the second tanks only;

if it is possible, providing a fluid communication from the pump assembly of a first of the inclination change assemblies to the second tank of the tank assembly of a second of the inclination change assemblies, and operating the pump assembly such that fluid is pumped from the second tank of the tank assembly of the first inclination change assembly to the second tank of the tank assembly of the second inclination change assembly.

Optionally, the method comprises transferring fluid that is not needed in order to obtain the inclination change to the first tanks prior to transferring fluid between the second tanks.

BRIEF DESCRIPTION OF THE DRAWINGS

With reference to the appended drawings, below follows a more detailed description of embodiments of the disclosure cited as examples.

In the drawings.

It should be noted that the appended drawings are not necessarily drawn to scale and that the dimensions of some features may have been exaggerated for the sake of clarity.

DETAILED DESCRIPTION OF PREFERRED EMBODIMENTS

Embodiments of the above discussed aspects will be presented hereinbelow. It should however be realized that the embodiments are included in order to explain principles of the invention and not to limit the scope of the invention, defined by the appended claims.

Figure 1:
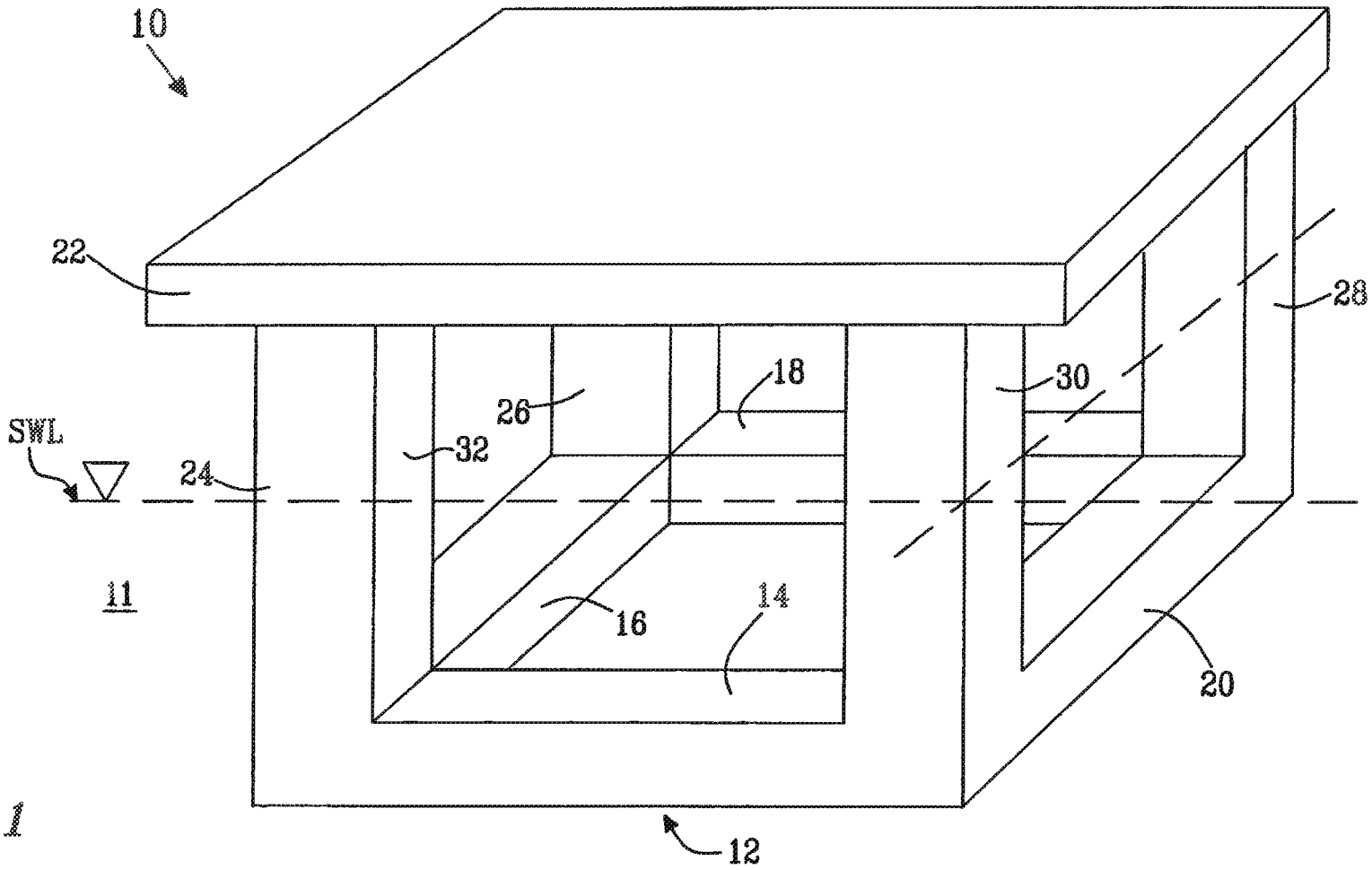
FIG. 1 illustrates a floating unit.

FIG. 1 illustrates a marine structure 10 of the prior art, which marine structure in FIG. 1 is a semi-submersible unit, adapted to float in a body of water 11 with a still water level SWL. The marine structure comprises a float 12 which is adapted to be located at least partially in the body of water 11 and, in the implementation of the marine structure illustrated in FIG. 1, the float 12 is adapted to be located below the aforesaid still water level SWL.

In the implementation of the marine structure 10 illustrated in FIG. 1, the float 12 is of a so called ring pontoon type and is thus constituted by four pontoons 14, 16, 18, 20 connected to one another so as to form the float 12. However, in other implementations of the marine structure 10, the float 12 may have a design which differs from the one illustrated in FIG. 1. As may be gleaned from FIG. 1, the marine structure 10 also comprises a deck structure 22, which deck structure 22 generally is adapted to be located above the still water level SWL.

Moreover, the marine structure 10 in FIG. 1 is provided with four supporting members, or supporting columns, 24, 26, 28, 30 extending between the float 12 and the deck structure 22.

Embodiments of a closed inclination change system according to the present invention will be presented hereinbelow. As a non-limiting example, a closed inclination change system of the present invention may preferably be suitable for a marine structure such as the marine structure 10 illustrated in FIG. 1. However, it is also envisaged that embodiments of the closed inclination change system of the present invention may be suitable for other types of floating units. Purely by way of example, an embodiment of the closed inclination change system may be suitable for at least one of the following types of floating units: a ship, a floating production storage and offloading unit (FPSO), a tension leg platform (TLP), a spar buoy, a barge and a floating dock.

Moreover, it should be noted that embodiments of the closed inclination change system may be suitable for a semi-submersible unit that has another design than the FIG. 1 implementation of a semi-submersible unit 10. Purely by way of example, an embodiment of the closed inclination change system may be suitable for a semi-submersible unit that has twin pontoons (not shown) and/or more or less than four supporting columns extending from the float to the deck. As a non-limiting example, an embodiment of the closed inclination change system may be suitable for a semi-submersible unit that has six supporting columns (not shown).

Figure 2:
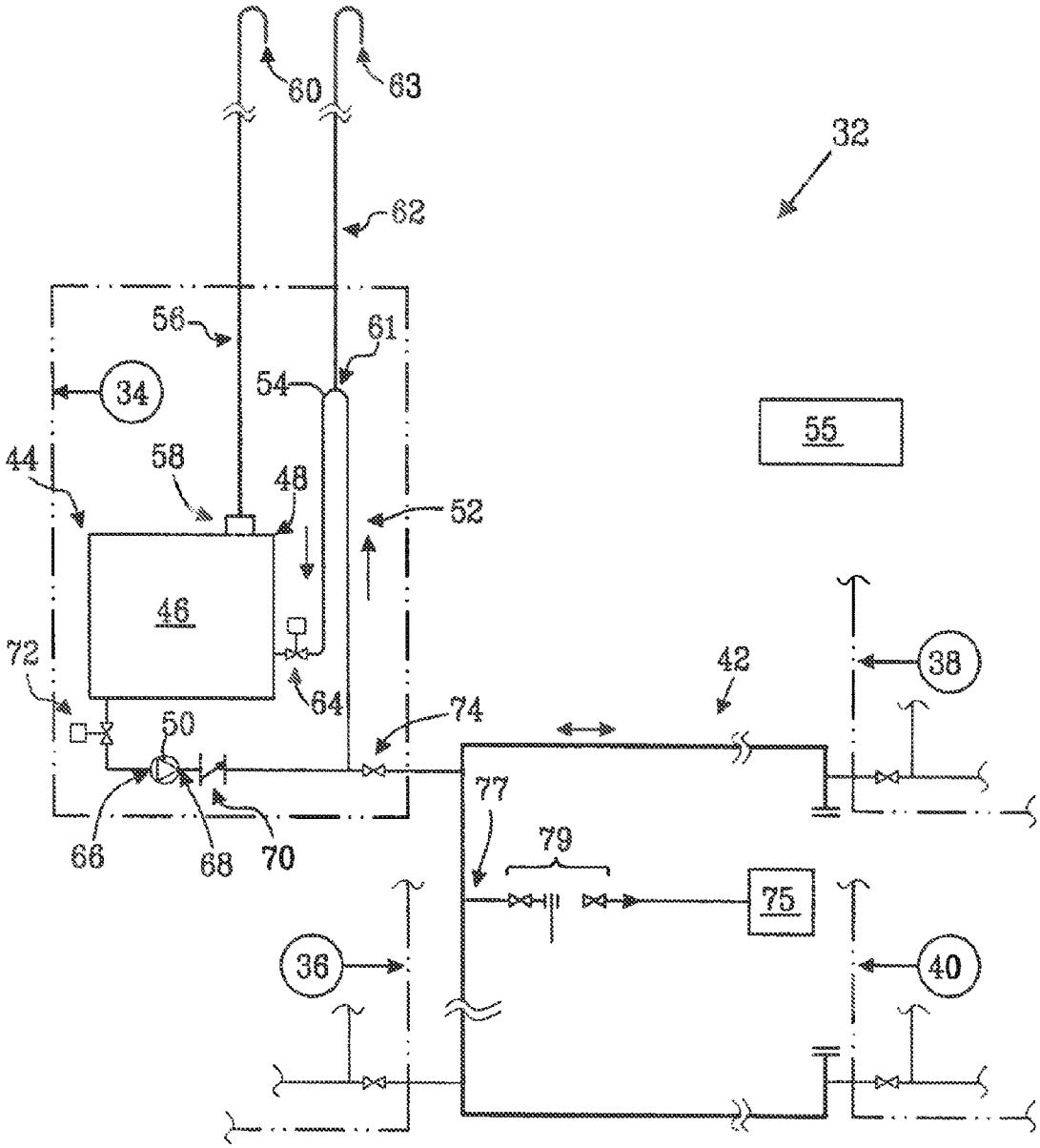
FIG. 2 schematically illustrates an embodiment of a closed inclination change system.

FIG. 2 illustrates an embodiment of a closed inclination change system 32 for a floating unit (not shown in FIG. 2). The closed inclination change system 32 of the present invention comprises a plurality of inclination change assemblies and the FIG. 2 embodiment comprises four inclination change assemblies, viz a first 34, a second 36, a third 38 and a fourth 40 inclination change assembly.

It should be noted that other embodiments of a closed inclination change system 32 may include fewer or more inclination change assemblies than four. As a non-limiting example, an embodiment of a closed inclination change system (not shown) may include only three inclination change assemblies. As another non-limiting example, an embodiment of a closed inclination change system (not shown) may comprise five or more inclination change assemblies.

FIG. 2 illustrates preferred features of an inclination change assembly using the first inclination change assembly 34 as an example. However, it should be noted that each one of the other inclination change assemblies 36, 38, 40 may comprise the same, or at least similar features, as the first inclination change assembly 34.

FIG. 2 illustrates that each one of the inclination change assemblies 34, 36, 38, 40 is adapted to be in fluid communication with each one of the other inclination change assemblies 34, 36, 38, 40. To this end, the FIG. 2 closed inclination change system 32 comprises a feeding circuit 42 adapted to be in fluid communication with each one of the inclination change assemblies 34, 36, 38, 40.

In the FIG. 2 embodiment of the closed inclination change system 32, each one of the inclination change assemblies 34, 36, 38, 40 comprises a tank assembly 44 comprising a first tank 46. The tank assembly 44 comprises a tank assembly top portion 48. The top portion 48 is located in the uppermost region of the tank assembly 44.

Moreover, each one of the inclination change assemblies 34, 36, 38, 40 further comprises a pump assembly 50 arranged to pump the fluid from the tank assembly 44. Further, each one of the inclination change assemblies 34, 36, 38, 40 comprises an inlet conduit assembly 52 adapted to guide the fluid into the tank assembly 44 from another inclination change assembly. The inlet conduit assembly 52 has a conduit top portion 54 that is located above the tank assembly top portion 48.

The fluid used in the closed inclination system 32 may be a liquid. Purely by way of example, the fluid used in the closed inclination change system 32 may be at least one of the following: fresh water or oil. The use of fresh water or oil may have the advantage that corrosion in the closed inclination change system 32 is relatively low. As another option, the fluid used in the closed inclination change system 32 may be sea water. The use of sea water may have the advantage that the sea water may be supplied from e.g. a ballast system of the floating unit as will be discussed hereinbelow.

The closed inclination change system 32 according to the present invention may be used for imparting an inclination change to a floating unit hosting the system 32. As such, the closed inclination change system 32 may be operated so as to provide a fluid communication from the pump assembly 50 of the first inclination change assembly 34 to the tank assembly of a second of said inclination change assemblies 36, 38, 40.

Moreover, the closed inclination change system 32 may be operated such that fluid is pumped from the tank assembly 44 of the first inclination change assembly 34 to the tank assembly of a second one of said inclination change assemblies 36, 38, 40.

The above discussed operation of the closed inclination change system 32 may be performed manually. As such, one or more operators may decide between which inclination change assemblies a fluid communication is to be provided. Moreover, the one or more operators may operate the pump assembly of one of the inclination change assemblies such that an appropriate amount of fluid is pumped from the tank assembly of the first inclination change assembly to the tank assembly of a second of said inclination change assemblies.

As another option, the closed inclination change system 32 preferably comprises a control unit 55, such as an electronic control unit. Purely by way of example, the control unit 55 may receive input as regards a desired inclination change to be imparted to the floating unit hosting the closed inclination change system 32. The control unit 55 may then automatically decide between which inclination change assemblies a fluid communication may be provided.

Moreover, although purely by way of example, the control unit 55 may be adapted to communicate with other portions of the closed inclination change system. As a non-limiting example, the control unit 55 may be adapted to communicate with other portions of the closed inclination change system 32 via electronic and/or hydraulic signals. As such, the control unit 55 may be adapted to control e.g. one or more valve assemblies of the closed inclination change system 32 in order to provide the desired fluid communication between two inclination change assemblies.

Additionally, although purely by way of example, the control unit 55 may also be adapted to control at least one pump assembly 50 of at least one of the inclination change assemblies 34, 36, 38, 40 such that fluid may be pumped from one inclination change assembly to one or more of the other inclination change assemblies.

The FIG. 2 embodiment of the closed inclination change system 32, at least one of the inclination change assemblies 34 comprises an first vent pipe assembly 56. The first vent pipe assembly 56 comprises an air inlet 58 located at the upper portion 48 of the tank assembly 44. The first vent pipe assembly 56 comprises an air outlet 60 located at a position above the tank assembly top portion 48. The air outlet 60 is adapted to be in fluid communication with the environment ambient of the closed inclination change system 32. FIG. 2 illustrates a preferred implementation of the first vent pipe assembly 56 in which the air outlet 60 is located above the conduit top portion 54.

FIG. 2 further illustrates that at least one of the inclination change assemblies 34 may comprise a second vent pipe assembly 62 providing a fluid communication between the conduit top portion 54 and ambient environment. To this end, the second vent pipe assembly 62 comprises a second air inlet 61 located at the conduit top portion 54. Moreover, the second vent pipe assembly 62 further comprises a second air outlet 63 which is in fluid communication with the environment ambient of the closed inclination change system 32. The second air outlet 63 is preferably located above the conduit top portion 54.

The provision of the second vent pipe 62 may reduce the risk that a suction due to the siphon principle may occur in the inlet conduit assembly 52. A suction in the inlet conduit assembly 52 may occur when fluid flows from the conduit top portion 54 to the tank assembly 44 and creates a negative pressure in the inlet conduit assembly 52. Such a negative pressure may result in that fluid in the portion of the inlet conduit assembly 52 that is located between the conduit top portion 54 and the feeding circuit 42 may be forced towards the tank assembly 44. The risk of obtaining such a negative pressure in the inlet conduit assembly is reduced by the provision of the second vent pipe assembly 62.

FIG. 2 further illustrates that the at least one of the inclination change assemblies 34, 36, 38, 40 may comprise an inlet cut-off valve 64 located in the tank inlet conduit assembly 52. Moreover, as may be gleaned from FIG. 2, the inlet cut-off valve 64 may preferably be located between the conduit top portion 54 and the tank assembly 44.

Moreover, FIG. 2 illustrates that at least one of the inclination change assemblies 34, 36, 38, 40 comprises a pump assembly 50 with a low side 66 and a high side 68. Moreover, in the FIG. 2 embodiment, at least one inclination change assembly 34, 36, 38, 40 further comprises a check valve 70 located downstream the high side 68.

Furthermore, FIG. 2 illustrates that at least one of the inclination change assemblies 34, 36, 38, 40 may comprise a pump assembly cut-off valve 72 located between the low side 66 and the tank assembly 44.

Moreover, in the FIG. 2 embodiment of the closed inclination change system 32, at least one of the inclination change assemblies 34, 36, 38, 40 comprises a control valve 74 adapted to control a fluid flow to and from the inclination change assembly 34.

FIG. 2 further illustrates that the closed inclination change system 32 may be arranged so as to selectively be in fluid communication with a ballast system 75. The selective fluid communication in FIG. 2 is achieved by the connection of a ballast system communication conduit 77 to the feeding circuit 42. The ballast system communication conduit 77 may for instance comprise a valve assembly 79 adapted to control any flow through the ballast system communication conduit 77.

Purely by way of example, the valve assembly 79 may be operated so as to allow a fluid communication between the closed inclination change system 32 and the ballast system 75 in an initial condition for the closed inclination change system 32, e.g. before or when the closed inclination change system 32 is to be used for the first time. However, during operations of the closed inclination change system 32 as such, the valve assembly 79 is preferably closed such that fluid communication between the closed inclination change system 32 and the ballast system 75 is prevented.

The closed inclination change system 32, such as the embodiment of the closed inclination change system 32 illustrated in FIG. 2, is preferably used in a method for imparting an inclination change to a floating unit.

The method comprises providing a fluid communication from the pump assembly 50 of a first 34 of the inclination change assemblies to the tank assembly of a second of the inclination change assemblies 36, 38, 40. Generally, the choice between which inclination change assemblies 34, 36, 38, 40 to provide a fluid communication may be dependent on the desired direction and magnitude of the inclination to be imparted to the floating unit. Purely by way of example, the choice between which inclination change assemblies 34, 36, 38, 40 to provide a fluid communication may be performed manually or automatically.

Moreover, the method comprises operating the pump assembly such that fluid is pumped from the tank assembly of the first inclination change assembly to the tank assembly of the second inclination change assembly. Purely by way of example, the operation of the pump assembly may be performed manually or automatically.

Figure 3:
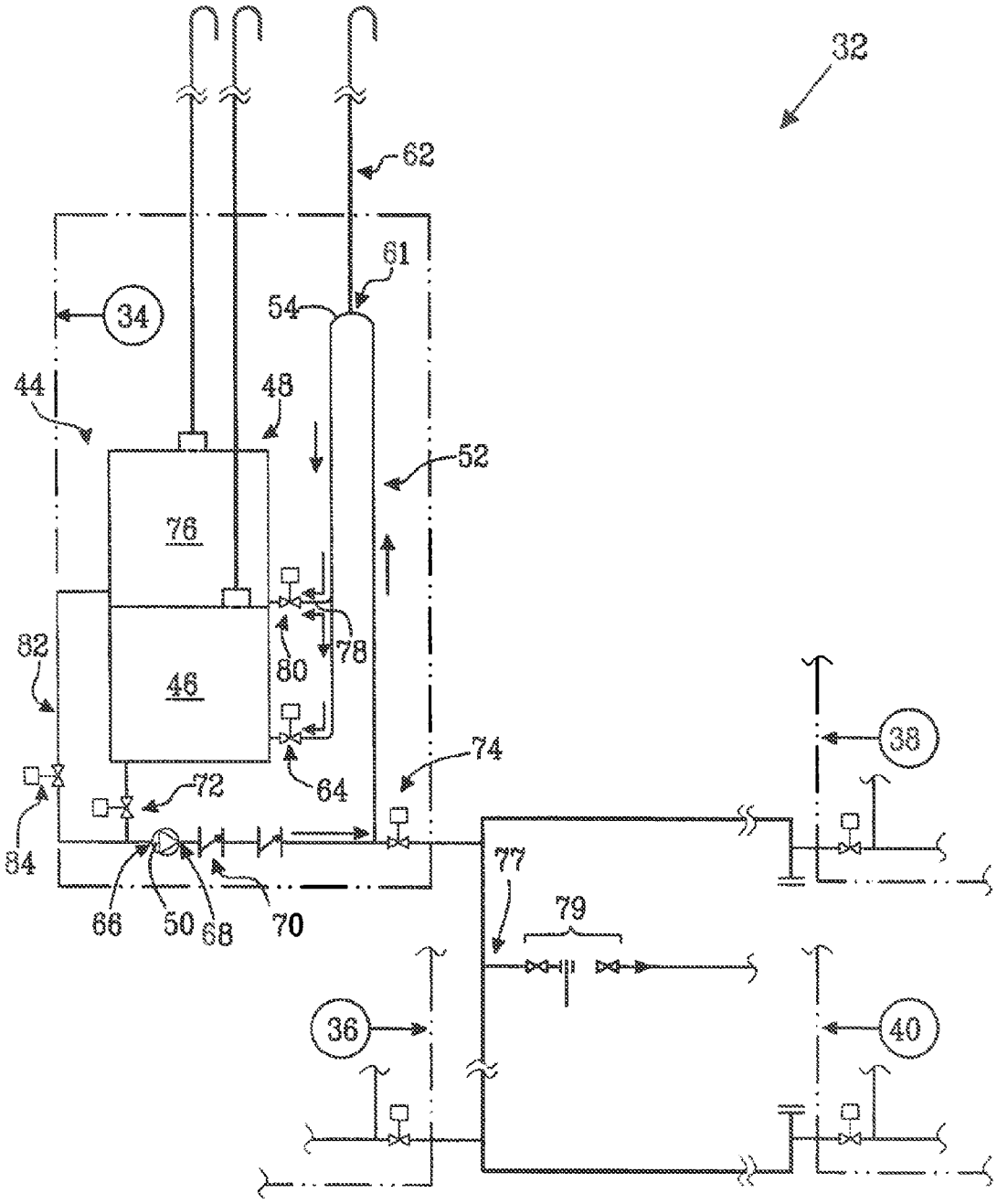
FIG. 3 schematically illustrates another embodiment of a closed inclination change system.

FIG. 3 illustrates another embodiment of a closed inclination change system. The FIG. 3 embodiment comprises features that are identical, or at least similar, to features of the FIG. 2 embodiment and such features have the same reference number in FIG. 3 as they do in FIG. 2.

As may be gleaned from FIG. 3, the embodiment of the closed inclination change system 32 disclosed therein comprises at least one inclination change assembly 34, 36, 38, 40, the tank assembly 44 of which comprises a second tank 76. Thus, in the FIG. 3 embodiment, the tank assembly 44 of at least one of the inclination change assemblies 34, 36, 38, 40 comprises two tanks 46, 76. Preferably, the second tank 76 is located at least partially above the first tank 46.

Moreover, in the FIG. 3 embodiment, the inlet conduit assembly 52 is also adapted to guide the fluid into the second tank 76 from another inclination change assembly. To this end, the tank inlet conduit assembly 52 preferably comprises a second conduit portion 78 adapted to guide fluid into the second tank 76. The second conduit portion 78 may preferably comprise a second inlet cut-off valve 80.

Purely by way of example, the first tank 46 and the second tank 76 may be in a permanent fluid communication with one another. As another non-limiting example, the first tank 46 and the second tank 76 may be arranged so as to selectively be in fluid communication with one another. To this end, although purely by way of example, the first inclination change assembly 34 may comprise a conduit (not shown) providing a fluid communication between the first and second tanks 46, 76 and the inclination change assembly 34 may also comprise a valve (not shown) by which the fluid communication between the first and second tanks 46, 76 may be controlled.

Instead of, or in addition, to the above-discussed conduit between the first and second tanks, a fluid communication between the first tank 46 and the second tank 76 may be provided via the inlet conduit assembly 52. As such, if the first inlet cut-off valve 64 and the second inlet cut-off valve 80 are open, a fluid transfer from the second tank 76 to the first tank 46 may be achieved. To this end, it may be preferred that the second conduit portion 78 is connected to the lowermost portion of the second tank 76.

Moreover, the implementation of the first inclination change assembly 34 illustrated in FIG. 3 is adapted to transfer fluid from the first tank 46 to the second tank 76 using the pump assembly 50. Such a fluid transfer may be achieved by closing valves 64, 74 and 84 and opening valves 72 and 80. The pump assembly 50 may thereafter be operated so as to pump fluid from the first tank 46 to the second tank 76.

In the FIG. 3 embodiment of the closed inclination change system 32, the first inclination change assembly 34 comprises a second tank conduit portion 82 adapted to provide a fluid communication between the second tank 76 and the low side 66 of the pump assembly 50. Moreover, the first inclination change assembly 34 comprises a second tank conduit valve 84 adapted to control the fluid communication via the second tank conduit portion 82.

Embodiments of the closed inclination change system 32 that comprises at least two inclination change assemblies 34, 36, 38, 40 wherein each one of these inclination change assemblies in turn comprises a first and a second tank 46, 76 may preferably be used in a method for imparting an inclination change to a floating unit using a closed inclination change system and an embodiment of such a method will be presented hereinbelow.

Purely by way of example, a starting configuration of the closed inclination change system 32 may be that any direct fluid communication between the first and second tanks 46, 76 is prevented within each one of the inclination change assemblies 34, 36, 38, 40 which comprises a first and second tank. An example of such a starting configuration is illustrated in FIG. 4A.

Figure 4A:
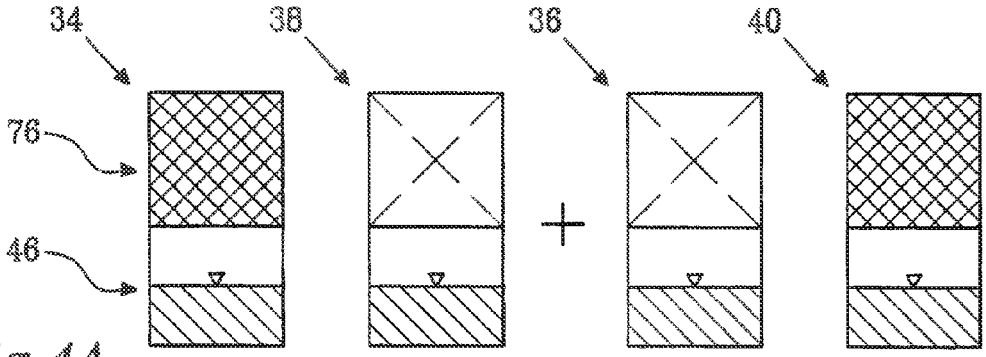
FIG. 4 schematically illustrates an inclination change sequence using the FIG. 3 embodiment.

As may be gleaned from FIG. 4A, the second tank of each one of the first 34 and the fourth 40 inclination change assemblies is substantially completely filled whereas the second tank of each one of the second 36 and third 38 inclination change assemblies is substantially empty. A configuration of the second tanks, such as the one illustrated in FIG. 4A, is generally preferred since completely filled or completely empty tanks will not significantly contribute to a reduced stability of the floating unit due to the so-called free liquid surface effect.

Moreover, the first tank of each one of the four inclination change assemblies is substantially half-filled.

The method comprises the step of determining if it is possible to obtain the desired inclination change by transferring fluid between the first tanks only. If it is determined that it actually is possible to impart the desired inclination change to the fluid unit by using the first tanks only, the method proceeds in a manner similar to the manner of the method that has been discussed hereinabove with reference to FIG. 2, i.e. the method comprises providing a fluid communication from the pump assembly of a first of the inclination change assemblies to the first tank of the tank assembly of a second one of the inclination change assemblies and operating the pump assembly such that fluid is pumped from the first tank of the tank assembly of the first inclination change assembly to the first tank of the tank assembly of the second inclination change assembly.

As an alternative, the method may also comprise determining if it is possible to obtain the inclination change by transferring fluid between the second tanks only, and if it is possible, providing a fluid communication from the pump assembly of a first of the inclination change assemblies 34, 36, 38, 40 to the second tank of the tank assembly of a second of the inclination change assemblies 34, 36, 38, 40;

operating the pump assembly such that fluid is pumped from the second tank of the tank assembly of the first inclination change assembly to the second tank of the tank assembly of the second inclination change assembly.

Figure 4B:
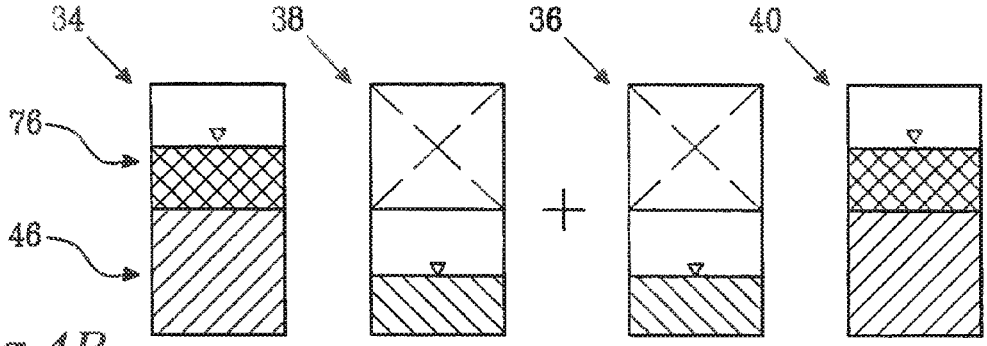

However, if it is determined that the use of both the first and the second tanks is required in order to impart the desired inclination change to the floating unit, the method preferably comprises providing a fluid communication between each one of the first tank 46 and its corresponding second tank 76. An example of a condition in which the above discussed configuration has been assumed is illustrated in FIG. 4B.

Figure 4C:
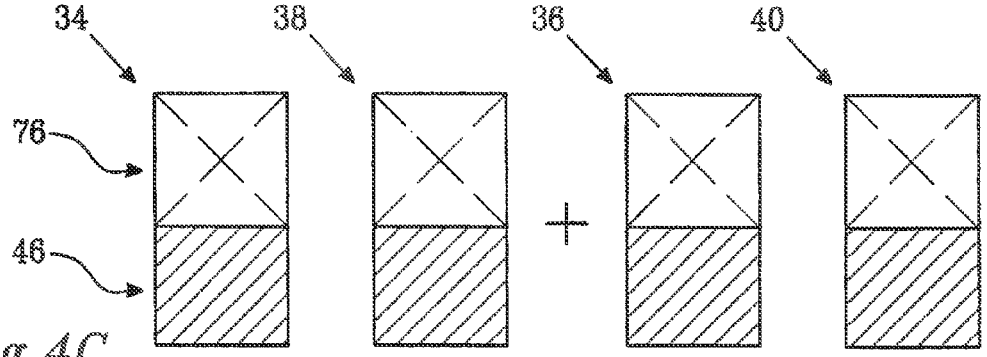
Figure 4D:
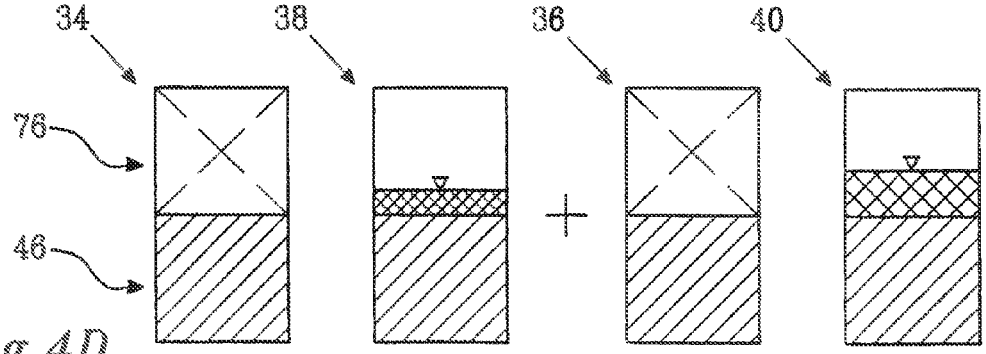

When the fluid communication between the first and second tanks 46, 76 of each one of the tank assemblies has be obtained, the appropriate fluid communication(s) is provided between selected inclination change assemblies and fluid is pumped therebetween. An example of a fluid distribution that could result from such a fluid transfer is illustrated in FIG. 4D. The FIG. 4D fluid distribution could be obtained directly from the FIG. 4B distribution. Optionally, the method could comprise a neutral fluid distribution, e.g. substantially the same amount of fluid in each one of the inclination change assemblies, being obtained before the FIG. 4D distribution is attained. An example of such a neutral fluid position is illustrated in FIG. 4C.

Figure 5A:
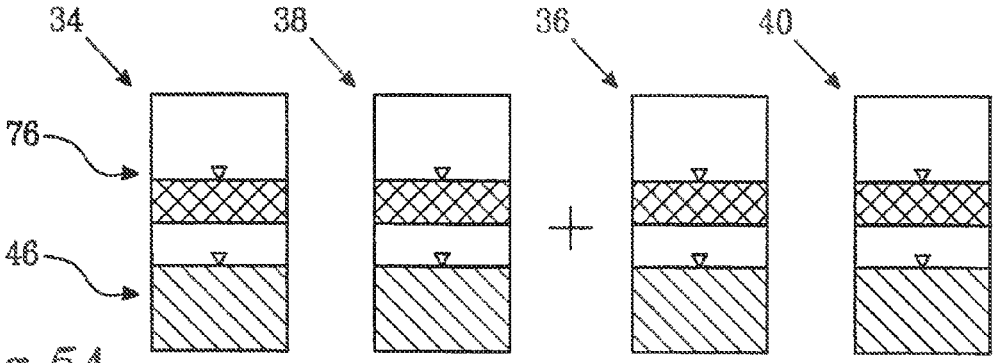
FIG. 5 schematically illustrates another inclination change sequence using the FIG. 3 embodiment.
Figure 5B:
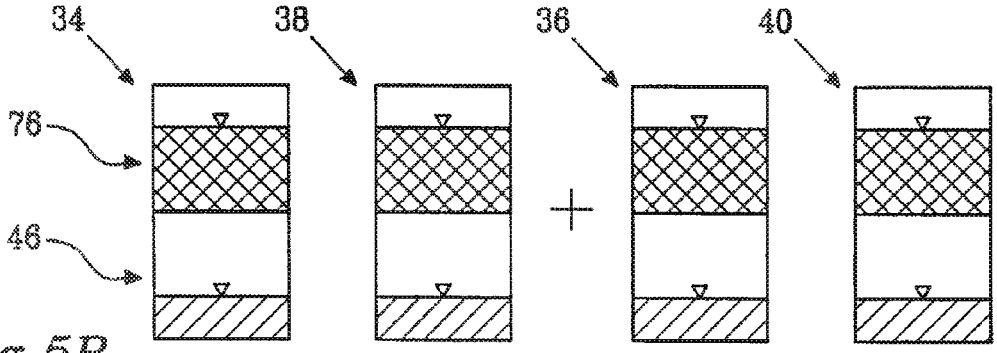
Figure 5C:
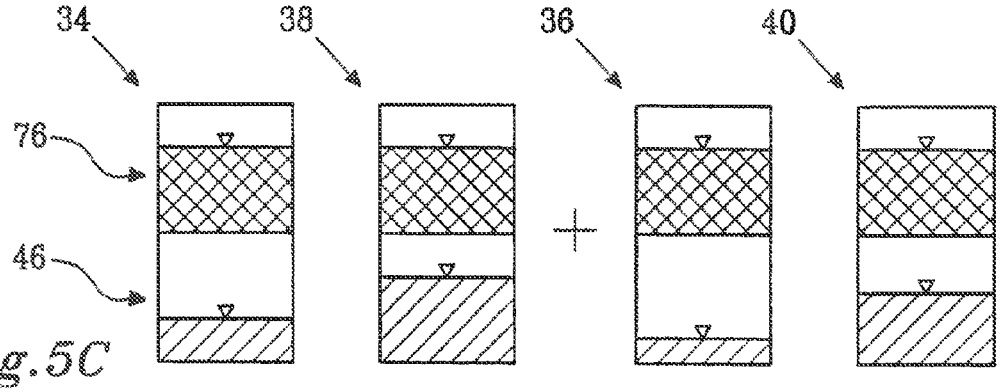

FIGS. 5A to 5C illustrate another embodiment of the method for imparting an inclination change to a floating unit. As in the FIG. 4 embodiment, the FIG. 5 embodiment of the method uses a closed inclination system that comprises inclination change assemblies each one of which having a first tank 46 and a second tank 76. In each inclination change assembly, the second tank 76 is located above the first tank 46.

FIG. 5A illustrates a starting condition for an embodiment of the method of imparting an inclination change to a floating unit. In the condition illustrated in FIG. 5A, the first tanks 46 contain a certain amount of fluid and the second tanks 76 contain a certain amount of fluid. Purely by way of example, substantially one third of each one of the second tanks 76 and approximately two thirds of each one of the first tanks 46 may be filled with fluid.

The embodiment of the method illustrated in FIG. 5 may also comprise that the amount of fluid that is needed in the first tanks 46, in order to be able to obtain the desired inclination change, is determined. Purely by way of example, the amount of fluid that is needed may be dependent on the magnitude and direction of the desired inclination. The FIG. 5 embodiment may also comprise that fluid that is not needed in order to obtain the desired inclination change is transferred to the second tanks 76 prior to pumping fluid between the first tanks, i.e. prior to transferring fluid in order to obtain the desired inclination change.

FIG. 5B illustrates a condition in which it has been determined that the desired inclination change may be obtained if substantially one third of each one of the first tanks 46 is filled with fluid. Thus, the residual fluid, i.e. the fluid that is not needed in order to obtain the desired inclination change, is transferred to the second tanks 76. Thus, FIG. 5B illustrates a condition in which substantially one third of each one of the first tanks 46 is filled with fluid whereas approximately two thirds of each one of the second tanks 76 is filled with fluid.

Fluid transfer between the first tanks 46 may thereafter commence in order to obtain the desired inclination change. However, in the FIG. 5 embodiment of the inclination change method, no fluid is transferred between the second tanks 76 during the inclination change procedure. FIG. 5C illustrates a condition in which fluid has been transferred between the first tanks 46 of the inclination change assemblies 34, 36, 38, 40.

It should be noted that although the FIG. 5 embodiment of the method uses fluid transfer between the first tanks 46 and stores residual fluid in the second tanks 76, it is also envisaged that embodiments of the method may store residual fluid in the first tanks 46 and transfer fluids between the second tanks 76 in order to impart an inclination change to a floating unit.

Figure 6:
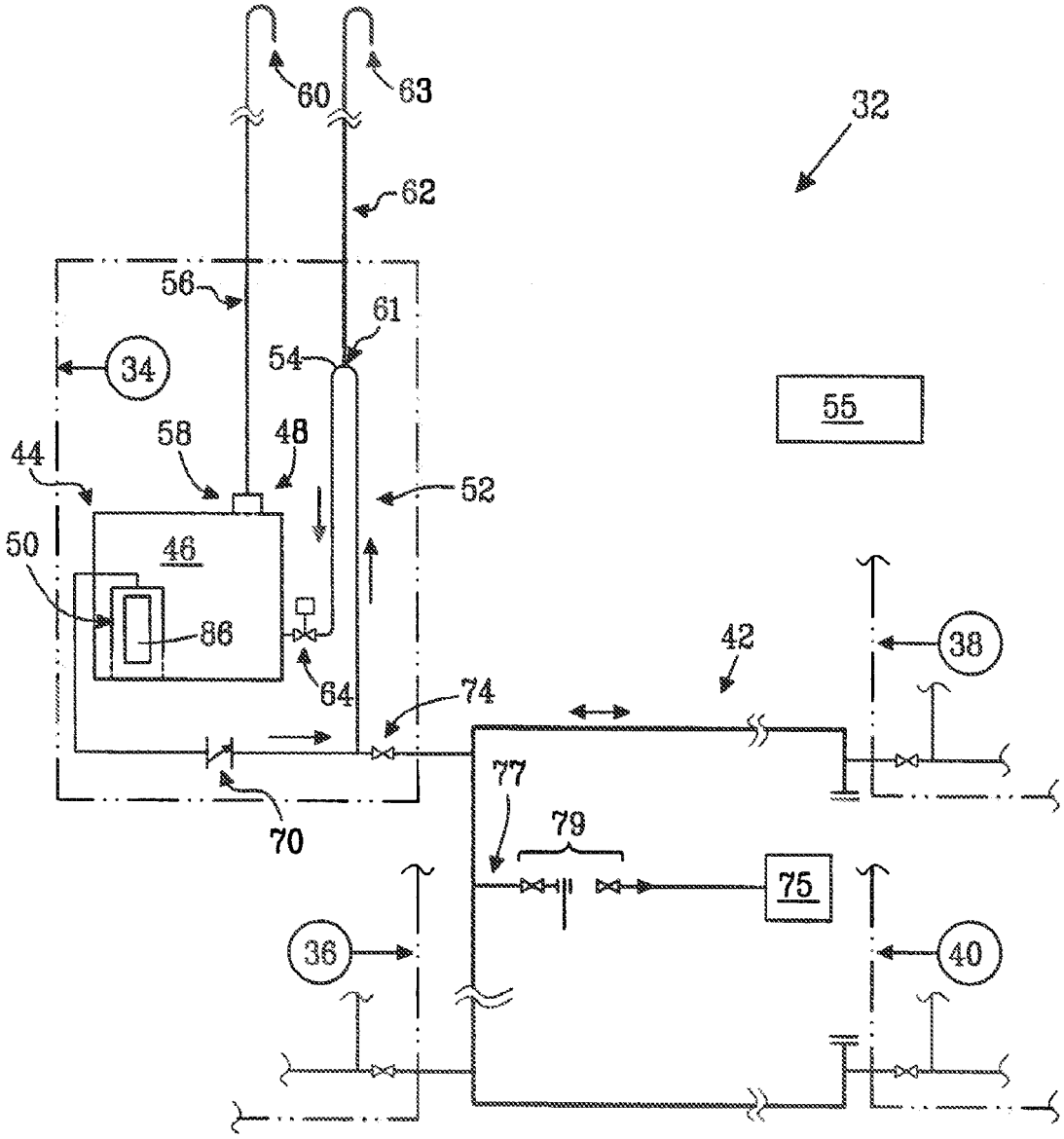
FIG. 6 schematically illustrates a further embodiment of a closed inclination change system.

FIG. 6 illustrates another embodiment of the closed inclination change system 32. In FIG. 6, the pump assembly 50 of at least one of the inclination change assemblies comprises a submersible pump 86.

The submersible pump 86 illustrated in FIG. 6 is associated with the first inclination change assembly 34. However, in other embodiments of the closed inclination change system 32, each one of the inclination change assemblies 34, 36, 38, 40 may comprise a submersible pump.

In the implementation of the first inclination change assembly 34 illustrated in FIG. 6, the submersible pump 86 is located in the first tank 46 of the first inclination change assembly 34.

However, in other embodiments of a closed inclination change system 32, an inclination change assembly may comprise a submersible pump that is located in a conduit (not shown) outside of the tank or tanks of an inclination change assembly.

Figure 7:
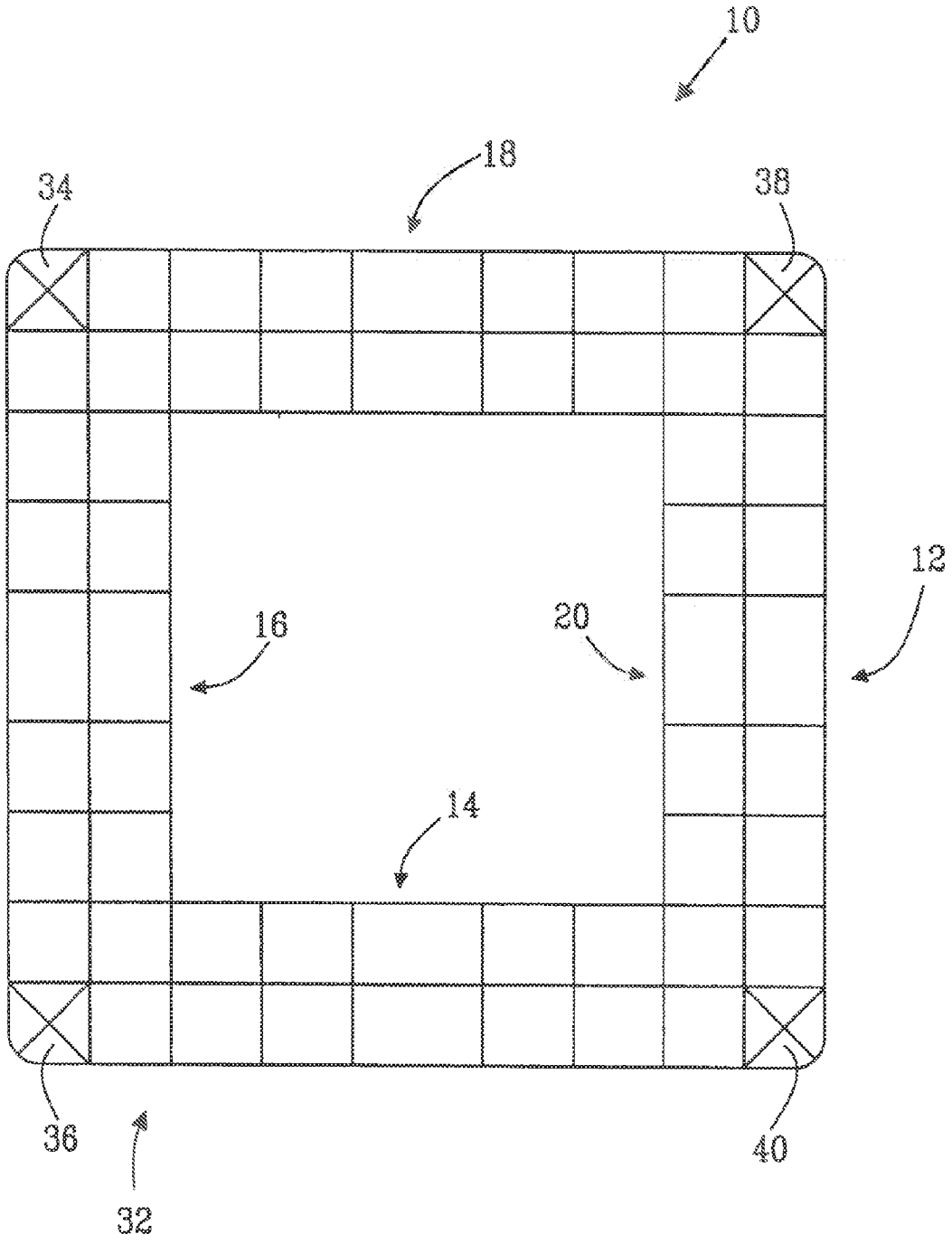
FIG. 7 illustrates a cross-sectional top view of the float of the FIG. 1 floating unit.

As has been intimated hereinabove, a closed inclination change system 32 may preferably be used in a semi-submersible unit. FIG. 7 is a top view of the float 12 of the FIG. 1 semi-submersible unit 10. The float 12 of the FIG. 7 unit 10 is of a so-called ring pontoon type in which four pontoons 14, 16, 18, 20 are connected to one another so as to form a closed rectangle.

Moreover, the semisubmersible unit 10 illustrated in FIG. 7 comprises four outermost supporting columns (not shown in FIG. 7, see instead FIG. 1) 24, 26, 28, 30.

In an embodiment of the closed inclination change system 32, the system 32 comprises four inclination change assemblies 34, 36, 38, 40, each one of the four inclination change assemblies 34, 36, 38, 40 being associated with an individual one of the four outermost supporting column such that the tank assembly of the inclination change assembly is located at least partially in and/or beneath the supporting column. In FIG. 7, each one of the inclination change assemblies 34, 36, 38, 40 is located at an outer corner of the rectangular float 12.

Generally, as regards the volume of the closed inclination change system 32, the total volume of the tank assemblies of all the inclination change assemblies 34, 36, 38, 40 of the closed inclination change system 32 may be less than 5%, preferably less than 2%, of the total volume displaced by the floating unit 10 when the floating unit 10 floats at an operational draught.

Finally, it should be recognized that structures and/or elements and/or method steps shown and/or described in connection with any disclosed form or embodiment of the invention may be incorporated in any other disclosed or described or suggested form or embodiment as a general matter of design choice. For instance, although a semi-submersible unit has been used as an example of a floating unit in the description presented hereinabove, a closed inclination change system could also be used in another type of floating unit, such as an FPSO, a barge, a tension leg platform, a SPAR buoy, a ship or the like. It is the intention, therefore, to be limited only as indicated by the scope of the claims appended hereto.

The invention claimed is:

1. A closed inclination change system for a floating unit, comprising:

a plurality of inclination change assemblies, each one of said inclination change assemblies in fluid communication with each one of the other inclination change assemblies, each one of said inclination change assemblies comprising:

a tank assembly comprising a first tank having a fluid, a tank assembly top portion of the first tank;

a pump assembly arranged to pump said fluid from said tank assembly, and an inlet conduit assembly guiding said fluid into said tank assembly from another inclination change assembly, said inlet conduit assembly having a conduit top portion that is located above said tank assembly top portion wherein the plurality of inclination change assemblies cooperate to change an inclination of the floating unit without transferring fluid to and from a water ambient to the floating unit.

2. The closed inclination change system according to claim 1, wherein at least one of said inclination change assemblies comprises a first vent pipe assembly, said a first vent pipe assembly comprising an air inlet located at the upper portion of said tank assembly in fluid communication with the environment ambient of said closed inclination change system, said air outlet being located at a position above said conduit top portion.

3. The closed inclination change system according to claim 1, wherein at least one of said inclination change assemblies comprises a second vent pipe assembly, said second vent pipe assembly comprising a second air inlet located at said conduit top portion, said second vent pipe assembly further comprising a second air outlet which is adapted to be in fluid communication with the environment ambient of said closed inclination change system said second air outlet being located above said conduit top portion.

4. The closed inclination change system according to claim 1, wherein at least one of said inclination change assemblies comprises an inlet cut-off valve located in said tank inlet conduit assembly said inlet cut-off valve being located between said conduit top portion and said tank assembly.

5. The closed inclination change system according to claim 1, wherein at least one of said inclination change assemblies comprises a pump assembly with a low side and a high side said at least one inclination change assembly further comprising a check valve located downstream said high side.

6. The closed inclination change system according to claim 5, wherein at least one of said inclination change assemblies comprises a pump assembly cut-off valve located between said low side and said tank assembly.

7. The closed inclination change system according claim 1, wherein at least one of said inclination change assemblies comprises a control valve adapted to control a fluid flow to and from said inclination change assembly.

8. The closed inclination change system according to claim 1, wherein said tank assembly of at least a first tank assembly of said inclination change assemblies comprises a second tank, said second tank being located at least partially above said first tank.

9. The closed inclination change system according claim 1, wherein said tank assembly of each one of said inclination change assemblies comprises a second tank said second tank being located at least partially above said first tank (46).

10. The closed inclination change system according to claim 8, wherein said inlet conduit assembly is also adapted to guide said fluid into said second tank from another inclination change assembly.

11. The closed inclination change system according to claim 8, wherein said first tank assembly is adapted to provide a fluid communication between said second tank and said first tank.

12. The closed inclination change system 923 according to claim 1, wherein said first tank assembly is adapted to transfer fluid from said first tank to said second tank using said pump assembly.

13. The closed inclination change system according to claim 1, wherein said closed inclination change system further comprises a feeding circuit adapted to be in fluid communication with each one of said inclination change assemblies.

14. The closed inclination change system according to claim 1, wherein said pump assembly of at least one of said inclination change assemblies comprises a submersible pump.

15. The closed inclination change system according to claim 1, further comprising a floating unit associated with the closed inclination change system.

16. The closed inclination change system according to claim 15, wherein said floating unit comprises a ballast system separated from said plurality of inclination change assemblies.

17. The closed inclination change system according to claim 1, further comprising a semi-submersible unit having four outermost supporting columns, said closed inclination change system comprising four inclination change assemblies, each one of said four inclination change assemblies being associated with an individual one of said four outermost supporting columns such that said tank assembly of said inclination change assembly is located at said supporting column.

18. The closed inclination change system according to claim 17, wherein said semi-submersible unit comprises a ring pontoon.

19. The closed inclination change system according to claim 17, wherein the total volume of the tank assemblies of all the inclination change assemblies of said closed inclination change system is less than 5% of the total volume displaced by the floating unit when the floating unit floats at an operational draught.

20. A method for imparting an inclination change to a floating unit using a closed inclination change system comprising a plurality of inclination change assemblies, each one of said inclination change assemblies in fluid communication with each one of the other inclination change assemblies, each one of said inclination change assemblies comprising: a tank assembly comprising a first tank and a tank assembly top portion; wherein each one of said inclination change assemblies further comprises: a pump assembly arranged to pump said fluid from said tank assembly, and an inlet conduit assembly guiding said fluid into said tank assembly from another inclination change assembly, said inlet conduit assembly having a conduit top portion that is located above said tank assembly top portion said method comprising:

providing a fluid communication from said pump assembly of a first of said inclination change assemblies to the tank assembly of a second of said inclination change assemblies and operating said pump assembly to pump said fluid from the tank assembly of said first inclination change assembly to the tank assembly of said second inclination change assembly, wherein the plurality of inclination change assemblies cooperate to change an inclination of the floating unit without transferring fluid to and from a water ambient to the floating unit.

21. The method according to claim 20, wherein said tank assembly of each one of said inclination change assemblies comprises a second tank, said second tank being located at least partially above said first tank, and comprising:

determining if it is possible to obtain said inclination change by transferring fluid between said first tanks only, and if it is possible, providing a fluid communication from said pump assembly of a first of said inclination change assemblies to said first tank of the tank assembly of a second of said inclination change assemblies;

operating said pump assembly such that fluid is pumped from the first tank of said tank assembly of said first inclination change assembly to said first tank of the tank assembly of said second inclination change assembly.

22. The method according to claim 21, further comprising:

transferring fluid that is not needed in order to obtain the inclination change to said second tanks (76) prior to transferring fluid between said first tanks.

23. The method according to claim 21, further comprising:

determining if it is possible to obtain said inclination change by transferring fluid between said second tanks only, and if it is possible, providing a fluid communication from said pump assembly of a first of said inclination change assemblies to said second tank of the tank assembly of a second of said inclination change assemblies operating said pump assembly such that fluid is pumped from the second tank of said tank assembly of said first inclination change assembly to said second tank of the tank assembly of said second inclination change assembly.

24. The method according to claim 23, further comprising:

transferring fluid that is not needed in order to obtain the inclination change to said first tanks prior to transferring fluid between said second tanks.

25. The method according to claim 20, further comprising:

providing a ballast system separate from the plurality of inclination change assemblies for the floating unit.

* * * * *